US006742509B2

(12) United States Patent
Hunter et al.

(10) Patent No.: US 6,742,509 B2
(45) **Date of Patent: *Jun. 1, 2004**

(54) RING AIRFOIL LAUNCHING SYSTEM

(76) Inventors: John W. Hunter, 15628 Bernardo Center Dr., #2606, San Diego, CA (US) 92127; Robert M. Fryer, 726 Seabright La., Solana Beach, CA (US) 92075; Philip J. Sluder, 4817 Palm Ave., Suite K, La Mesa, CA (US) 91941-3840; Robert A. Rauch, 13526 Aldrin Ave., Poway, CA (US) 92064

( * ) Notice: Subject to any disclaimer, the term of this patent is extended or adjusted under 35 U.S.C. 154(b) by 0 days.

This patent is subject to a terminal disclaimer.

(21) Appl. No.: 10/175,730

(22) Filed: Jun. 20, 2002

(65) Prior Publication Data

US 2003/0234013 A1 Dec. 25, 2003

(51) Int. Cl.[7] ..... F41B 7/00; F41F 7/00

(52) U.S. Cl. ..... 124/17; 124/20.1; 446/39; 446/64

(58) Field of Search ..... 446/39, 45, 63, 446/64, 65; 124/10, 17, 20.1, 41.1, 79

(56) References Cited

U.S. PATENT DOCUMENTS 3,949,731 A * 4/1976 Caso ..... 124/27
4,050,438 A * 9/1977 Pfotenhauer ..... 124/20.1
4,154,012 A * 5/1979 Miller ..... 42/105
4,169,453 A * 10/1979 Hunsicker ..... 124/20.1
4,291,663 A * 9/1981 Buck et al. ..... 124/26
4,335,701 A * 6/1982 Bozich ..... 124/26
5,125,388 A * 6/1992 Nicely et al. ..... 124/20.1
5,970,970 A * 10/1999 Vanek et al. ..... 124/16
6,079,398 A * 6/2000 Grimm ..... 124/16
6,599,161 B2 * 7/2003 Hunter ..... 446/39

* cited by examiner

*Primary Examiner*—Derris H. Banks
*Assistant Examiner*—Ali F Abdelwahed
(74) *Attorney, Agent, or Firm*—Fehr Law Firm; Thompson E. Fehr

(57) ABSTRACT

An airfoil launching system having a rod with a structure attached to a first end of the rod. A pusher holds a ring airfoil and has a sufficient coefficient of friction that the ring airfoil will generally rotate with the pusher and is rotatably and slidably mounted on the rod. Propulsive force is provided by resilient bands connected to the structure outward from the rod and to the pusher outward from the central aperture of the pusher. A grip attached to the pusher is utilized to draw the pusher toward the second end of the rod, thereby stretching and energizing the resilient bands, and also to rotate the pusher and, consequently, the airfoil.

17 Claims, 6 Drawing Sheets

RING AIRFOIL LAUNCHING SYSTEM

BACKGROUND OF THE INVENTION

1. Field of the Invention

This invention relates to a launcher for a ring airfoil projectile.

2. Description of the Related Art

There are a number of devices for launching projectiles.

U.S. Pat. No. 4,154,012 employs a rod within a barrel to facilitate the launching of a grenade.

U.S. Pat. No. 4,291,663 has a rod containing a helical groove for launching a ball that spins as it moves longitudinally. Lines 63 through 65 in column 3 declare, ". . . the rod 18 is a hollow cylinder with a long, thin aperture 51 describing a portion of a helical path about its exterior." Furthermore, lines 9 through 14 in column 3 explain, ". . . the trigger operating device 22 presses against the trigger (not shown in FIG. 1) of the launcher 24. This releases the launcher 24 which is spring driven to impel the ball 28 along the length of the rod [member] 18 and cause it to be thrown in a line in the direction of the axis of the rod 18." And lines 31 through 35 in column 4 indicate, "It should be noted that in the preferred embodiment the launcher 24 travels a helical path described by the aperture 51 so that a spin is imparted to the ball."

U.S. Pat. Nos. 5,970,970 and 6,079,398 both cover a launching rod having a fixed helical groove or aperture to launch a ring airfoil with a spin having been imparted to the airfoil through interaction of the launch platform with the groove.

The disclosure of U.S. Pat. No. 5,970,970 also explains, "Propelling element 62 is associated with ring airfoil support 60 and is configured to move the ring airfoil support along member 58. Such movement may involve acceleration and deceleration. Propelling element 62 is best seen in FIG. 8. In launcher 20, propelling element 62 takes the form of a spring having two ends, where one end is attached to a knob 82 inside the forward end of member 58 and the other end is attached to pin 78 as it passes through member 58."

U.S. Pat. No. 5,970,970 further clarifies, "Trigger 28 . . . holds ring airfoil support 60 in the first, cocked position, in which energy is stored in the launcher, and releases ring airfoil support 60 upon actuation of the trigger to permit the ring airfoil support to move along member 58 to the second, fired position, in which energy is transferred to the ring airfoil."

Finally, the disclosure in U.S Pat. No. 5,970,970 says, "Member 58 also may have a channel 68 disposed along at least a portion of its length. This channel may take a number of forms. In launcher 20, channel 68 takes the form of two helical slots disposed on opposite sides of member 58 and making about one-quarter turn along the length of the member." It does not appear that any other embodiment is described in U.S. Pat. No. 5,970,970 for causing the airfoil to rotate.

And U.S. Pat. No. 6,079,398 provides, "further secured over forward end 140 is a launch spring 148 (illustrated as a cylinder and preferably a metal coil spring) and a launch chuck 150. Chuck 150 includes a sleeve portion 152 having an inner diameter 154 in which a pair of tabs (not shown) are formed. The tabs engage slots 138. Slots 138 form a helical twist which causes a rotation of chuck 150 as it moves axially along shaft 100. Launch spring 148 bears between collar 142 and chuck 150, and chuck 150 is retained on forward end 140 by a bumper 156 and a retainer 158 that is secured to forward end 140. Chuck 150 is formed with a plurality of radially outwardly extending arms 160, that are adapted to engage inner surface 46 of a ring airfoil 34, and outwardly extending tabs 162 adapted to engage trailing edge 45 of ring airfoil 34.

None of the preceding patents provide for altering the degree of spin.

In application Ser. No. 10/000,274 of John w. Hunter, Ph.D., though, the rotation of the airfoil is adjustable and is accomplished with two or more resilient bands. The degree of axial rotation is determined by the amount which a spin guide is rotated about the longitudinal axis of the launch guide. The two resilient bands are angularly rotated by the spin guide to the same extent as is the spin guide.

SUMMARY OF THE INVENTION

Surprisingly, however, the present inventors have discovered that adjustable rotation of the airfoil can be successfully accomplished without any channel or spin guide. For this purpose, a grip is simply attached to the pusher.

DESCRIPTION OF THE PREFERRED EMBODIMENT

Figure 1:
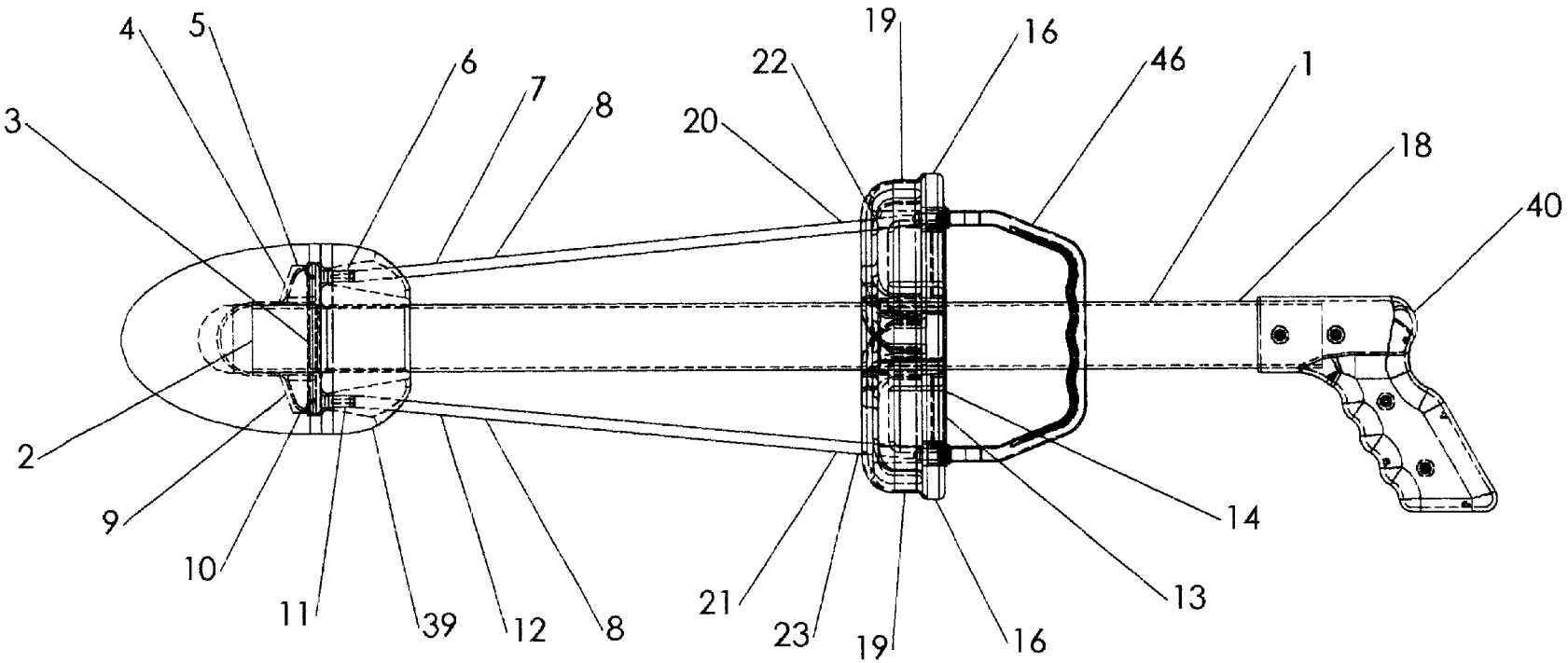
FIG. 1 depicts the airfoil launching system of the present invention.
Figure 2:
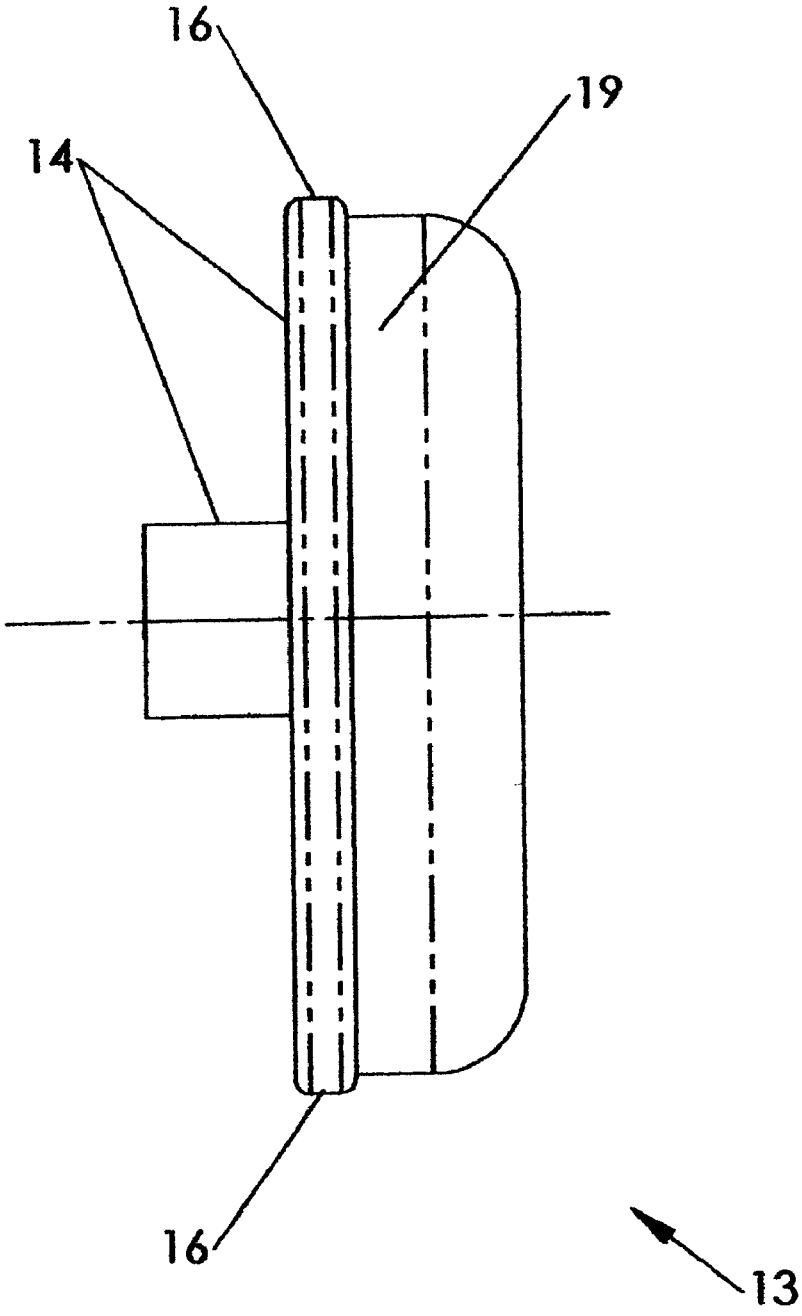
FIG. 2 is a lateral view of a pusher.
Figure 3:
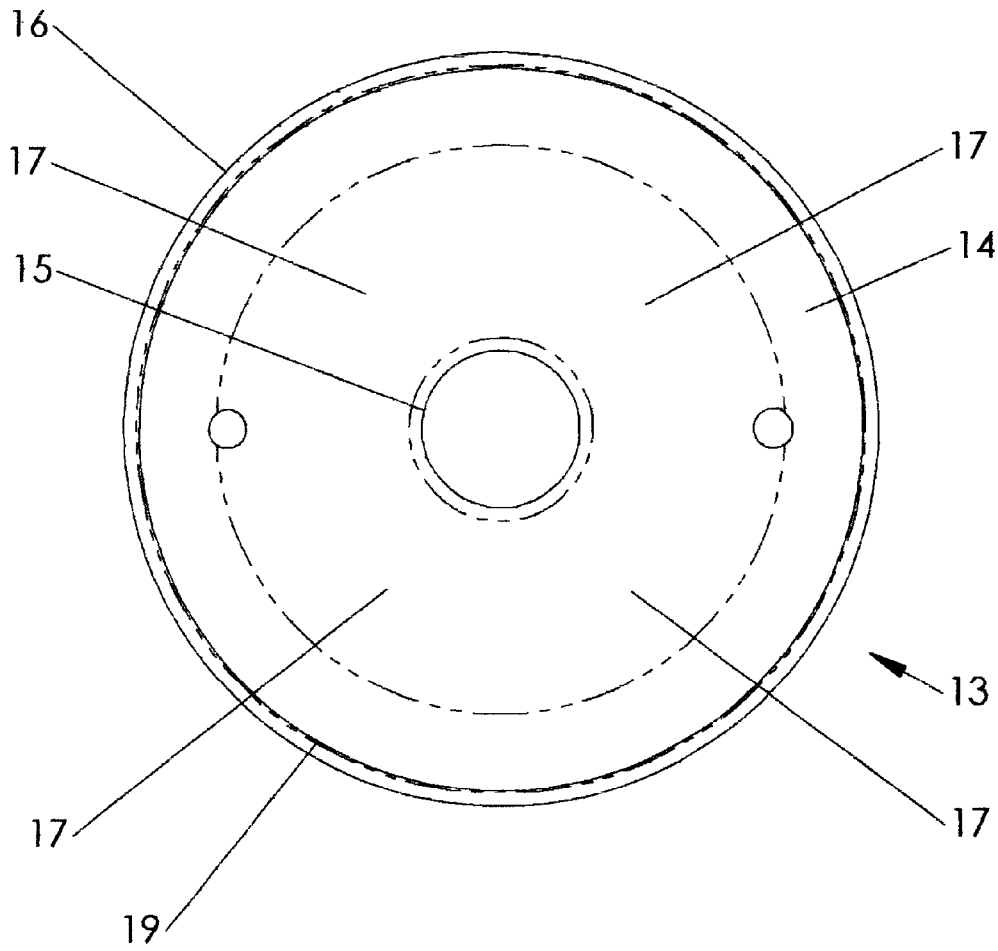
FIG. 3 is a plan view from the front of a pusher.

The present airfoil launching system has a rod 1 termed a "launch guide."

Attached toward a first end 2 of the rod 1 is a support 3 that extends radially outward from the rod 1.

Connected to a first side 4 of the support 3 outward from the rod 1 and preferably, but not necessarily, near a first end 5 of the support 3 is a first end 6 of a first set 7 of resilient bands 8, which set 7 comprises one or more resilient bands 8. Similarly, attached to a second side 9 of the support 3 outward from the rod 1 and preferably, but not necessarily, near a second end 10 of the support 3 is a first end 11 of a second set 12 of resilient bands 8, which set 12 comprises one or more resilient bands 8. Preferably, there is a single resilient band 8 in each set 7 and 12 which is preferably latex tubing which can be obtained either from Elastomer Products, Inc. of Kent, Ohio, or from Primeline Industries of Del Rio, Tex.

A pusher 13 is a generally disc-shaped structure 14 which contains a central aperture 15; has an outer diameter 16; and preferably, but not necessarily, contains one or more apertures 17 between the central aperture 15 and the outer diameter 16 in order to reduce the air resistance and the weight of the pusher 13.

The central aperture 15 is sized to permit the pusher 13 to rotate and slide along the rod 1, upon which the pusher 13 is mounted between the support 3 and a second end 18 of the rod 1. In order to reduce balloting as the pusher 13 moves along the rod 1, the thickness of the generally disc-shaped structure 14 is extended near the central aperture 15.

Figure 4:
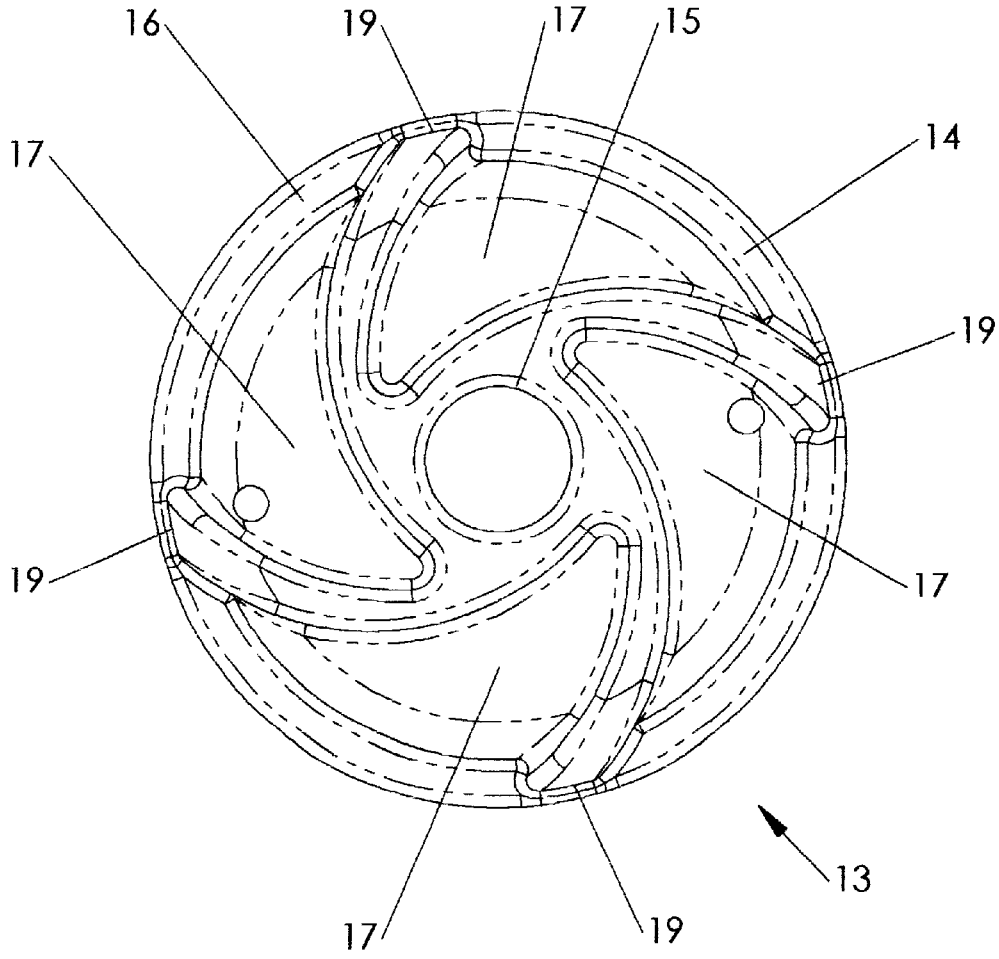
FIG. 4 is a plan view from the front of a pusher having a non-continuous flange.
Figure 5:
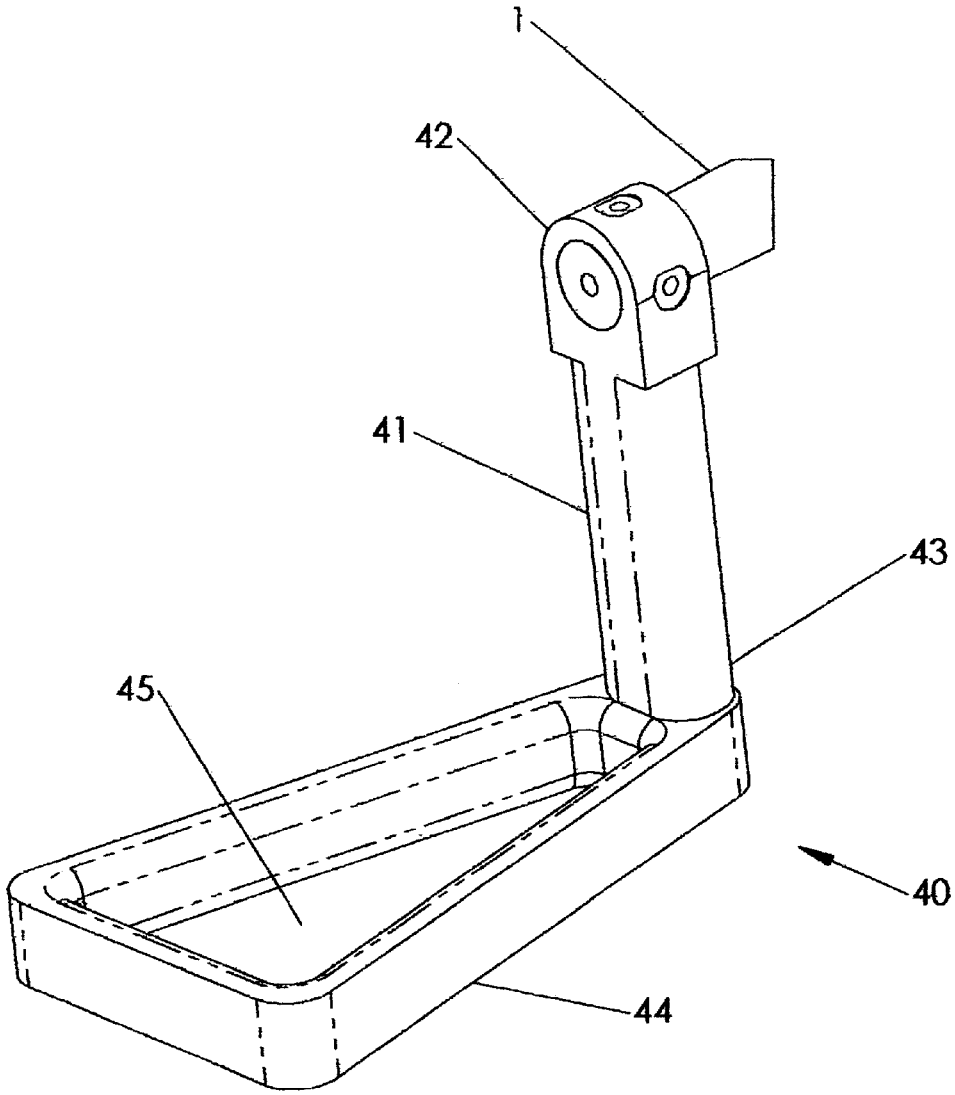
FIG. 5 shows an alternate embodiment of a rod handle.
Figure 6:
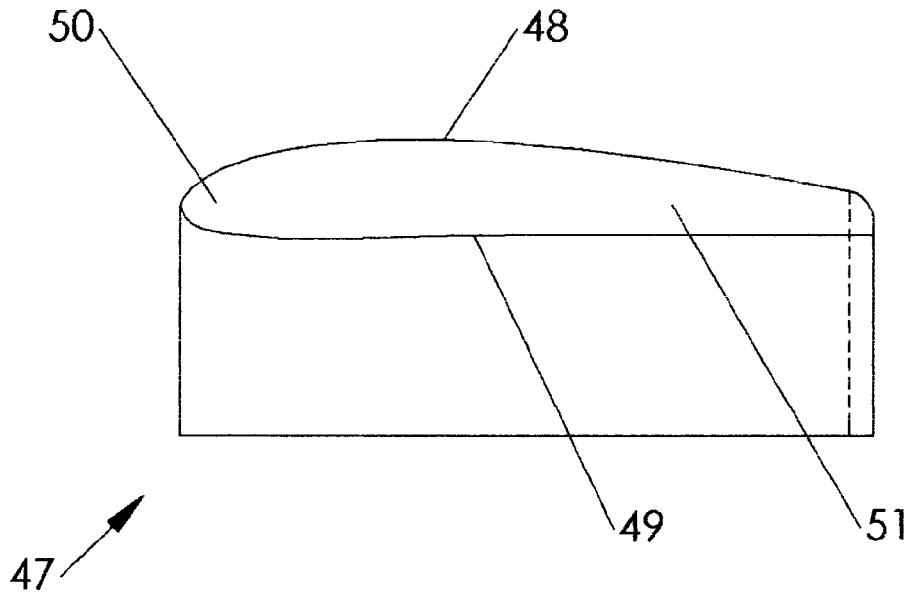
FIG. 6 illustrates a cross section of a ring airfoil.

Inward from the outer diameter 16 of the pusher 13 is a flange 19 which is sized to hold the inner side of a ring airfoil. Although the flange 19 may be continuous, it need not be; there only need be present so much of the flange 19 as is necessary to support a ring airfoil, as illustrated in FIG. 4. The material from which the generally disc-shaped structure 14 and preferably, but not necessarily, the entire pusher 13 is constructed is selected to have a coefficient of friction which will cause a ring airfoil placed on the pusher 13 generally to rotate with the pusher 13. Optionally, the pusher 13 is coated with paint such as PLASTI DIP, which is available from Plasti Dip International of Blaine, Minn., in order to increase the coefficient of friction.

A second end 20 of the first set 7 of resilient bands 8 is attached to the generally disc-shaped structure 14 outward from the central aperture 15; and a second end 21 of the second set 12 of resilient bands 8 is connected to the generally disc-shaped structure 14 outward from the central aperture 15 in a different location 23 from the point of attachment 22 for the first set 7 and preferably, but not necessarily, substantially opposite (across the central aperture 15) to the point of attachment 22 for the first set 7. A preferred method of attachment of the resilient bands 8 when such bands are latex tubing is to wet the tubing with isopropyl alcohol and then push such tubing onto a projection from the pusher 13 and then allowing the isopropyl alcohol to evaporate.

A grip 46 is attached to the pusher 13 in any location where it will not interfere with the rod 1 as it is used to draw the pusher 13 toward the second end 18 and to rotate the pusher 13 and, therefore, the first set 7 and the second set 12 of resilient bands 8. The grip 46 can be any structure that can be used to draw the pusher 13 toward the second end 18 and to rotate the pusher 13. Preferably, however, it is a traditional handle the ends of which are snap fit into the pusher. Another non-exclusive example of an acceptable grip 46 is finger holes formed into the pusher 13.

Preferably, but not necessarily, a bumper 39 is connected to the rod 1 near the support 3 so that said bumper 39 is at least on the side of the support 3 that is toward the pusher 13. Such a bumper 39 cushions the impact of the pusher 13. The bumper 39 can be any shock-absorbing device that is known in the art but is preferably a rounded block of expanded polyethylene. Preferably, the pusher 13 is also made of expanded polyethylene. Expanded polyethylene can be purchased from Marko Foam of Corona, Calif.

Also preferably, but not necessarily, a rod handle 40 is attached to the rod 1 near the second end 18 of the rod 1. Preferably, but not necessarily, this rod handle 40 is in the shape of a traditional pistol grip. Alternatively, however, the rod handle has a portion 41 with a first end 42 that is attached to the rod 1 and extends at an angle from the rod 1. Connected to a second end 43 of the portion 41 is a section 44 that is generally parallel to the rod 1 and contains an aperture 45 to accommodate the wrist of a user.

The rod 1 and the rod handle 40 are preferably hollow and made of high-density polyethylene containing ultraviolet-light inhibitors, which can be obtained from Inplex, LLC of Des Plaines, Ill. A non-exclusive list of alternate material for the high-density polyethylene is either polypropylene or nylon.

Although, any ring airfoil 47 is acceptable for launching with the Ring Airfoil Launching System, preferably the ring airfoil has an RG-15 exterior 48 and a substantially flat interior 49 with a nose 50 that is harder than the body 51 of the airfoil 47. The nose 50 is preferably composed of soft plastic such as KRATON, which is available from GLS Corporation of Arlington Heights, Ill.; and the body is preferably made with expanded polyethylene.

When the preferred materials are employed, the ring airfoil 47 and the entire Ring Airfoil Launching System have the advantage of being floatable on water.

As used herein the term "preferable" or "preferably" means that a specified element or technique is more acceptable than another but not that such specified element or technique is a necessity.

We claim:

1. A ring airfoil launching system, which comprises:

a rod having a first end and a second end;

a support having a first side and a second side, being attached to said rod, and extending radially outward from said rod;

a first set of resilient bands, said first set having a first end and a second end and having the first end connected to the first side of said support outward from said rod;

a second set of resilient bands, said second set having a first end and a second end and having the first end connected to the second side of said support outward from said rod;

a pusher slidably mounted on said rod between said support and the second end of said rod, said pusher comprising:

a generally disc-shaped structure containing a central aperture sized to permit said pusher to rotate and to slide along said rod and having an outer diameter, wherein said generally disc-shaped structure is composed of material having a coefficient of friction which will cause a ring airfoil placed on said pusher generally to rotate with said pusher and wherein a second end of said first set of resilient bands as well as a second end of said second set of resilient bands is attached to said generally disc-shaped structure at points of attachment outward from the central aperture; and a flange attached to said generally disc-shaped structure inward from the outer diameter of said generally disc-shaped structure wherein, said flange is sized to hold an inner side of a ring airfoil; and a grip attached to said pusher in any location where it will not interfere with said rod.

2. The ring airfoil launching system as recited in claim 1, wherein:

the second end of said second set of resilient bands is attached to said generally disc-shaped structure substantially opposite, with reference to the central aperture, to the point of attachment for said first set of resilient bands.

3. The ring airfoil launching system as recited in claim 2, wherein:

said grip is a handle.

4. The ring airfoil launching system as recited in claim 3, further comprising:

a rod handle attached to said rod near the second end of said rod.

5. The ring airfoil launching system as recited in claim 4, further comprising:

a bumper connected to said rod near said support so that said bumper is at least on a side of said support that is toward said pusher.

6. The ring airfoil launching system as recited in claim 3, further comprising:

a bumper connected to said rod near said support so that said bumper is at least on a side of said support that is toward said pusher.

7. The ring airfoil launching system as recited in claim 2, further comprising:

a rod handle attached to said rod near the second end of said rod.

8. The ring airfoil launching system as recited in claim 7, further comprising:

a bumper connected to said rod near said support so that said bumper is at least on a side of said support that is toward said pusher.

9. The ring airfoil launching system as recited in claim 2, further comprising:

a bumper connected to said rod near said support so that said bumper is at least on a side of said support that is toward said pusher.

10. The ring airfoil launching system as recited in claim 1, wherein:

said grip is a handle.

11. The ring airfoil launching system as recited in claim 10, further comprising:

a rod handle attached to said rod near the second end of said rod.

12. The ring airfoil launching system as recited in claim 11, further comprising:

a bumper connected to said rod near said support so that said bumper is at least on a side of said support that is toward said pusher.

13. The ring airfoil launching system as recited in claim 10, further comprising:

a bumper connected to said rod near said support so that said bumper is at least on a side of said support that is toward said pusher.

14. The ring airfoil launching system as recited in claim 1, further comprising:

a rod handle attached to said rod near the second end of said rod.

15. The ring airfoil launching system as recited in claim 14, further comprising:

a bumper connected to said rod near said support so that said bumper is at least on a side of said support that is toward said pusher.

16. The ring airfoil launching system as recited in claim 1, further comprising:

a bumper connected to said rod near said support so that said bumper is at least on a side of said support that is toward said pusher.

17. The ring airfoil launching system as recited in claim 1, further comprising:

a ring airfoil having a nose, a body, an interior, and an exterior with the exterior being an RG-15 airfoil, the interior being substantially flat, and the nose being harder than the body.

* * * * *